US008038775B2

(12) United States Patent
Gefter

(10) Patent No.: US 8,038,775 B2
(45) Date of Patent: Oct. 18, 2011

(54) SEPARATING CONTAMINANTS FROM GAS IONS IN CORONA DISCHARGE IONIZING BARS

(76) Inventor: Peter Gefter, South San Francisco, CA (US)

( * ) Notice: Subject to any disclaimer, the term of this patent is extended or adjusted under 35 U.S.C. 154(b) by 0 days.

(21) Appl. No.: 13/021,020

(22) Filed: Feb. 4, 2011

(65) Prior Publication Data

US 2011/0126712 A1 Jun. 2, 2011

Related U.S. Application Data

(63) Continuation-in-part of application No. 12/799,369, filed on Apr. 23, 2010.

(60) Provisional application No. 61/214,519, filed on Apr. 24, 2009, provisional application No. 61/276,792, filed on Sep. 16, 2009, provisional application No. 61/279,784, filed on Oct. 26, 2009, provisional application No. 61/337,701, filed on Feb. 11, 2010.

(51) Int. Cl.
*B03C 3/36* (2006.01)

(52) U.S. Cl. ..... 96/63; 95/78; 96/97; 361/213; 361/233

(58) Field of Classification Search ..... 96/52, 54, 96/60, 62, 63, 95–97; 95/58, 78; 361/213, 361/225–235
See application file for complete search history.

(56) References Cited

U.S. PATENT DOCUMENTS

| | | | | |
|---|---|---|---|---|
| 3,374,941 A | | 3/1968 | Okress | 315/111.91 |
| 3,585,060 A | | 6/1971 | Gourdine et al. | 427/460 |
| 3,764,804 A | * | 10/1973 | Hirschman | 250/324 |
| 3,768,258 A | * | 10/1973 | Smith et al. | 60/275 |
| 4,258,736 A | | 3/1981 | Denbow | 137/2 |
| 4,734,105 A | | 3/1988 | Eliasson et al. | 95/62 |
| 4,812,711 A | | 3/1989 | Torok et al. | 315/111.91 |
| 4,976,752 A | * | 12/1990 | Torok et al. | 96/43 |
| 5,116,583 A | | 5/1992 | Batchelder et al. | 422/186.07 |
| 5,296,018 A | | 3/1994 | Suzuki | 95/65 |
| 5,447,763 A | * | 9/1995 | Gehlke | 428/34.1 |
| 5,550,703 A | | 8/1996 | Beyer et al. | 361/229 |
| 5,650,203 A | * | 7/1997 | Gehlke | 428/34.1 |

(Continued)

FOREIGN PATENT DOCUMENTS

JP 2004273293 9/2004

(Continued)

OTHER PUBLICATIONS

Freescale Semiconductor, Inc. datasheet (Rev 0) for MPXV6115 Series including data for MPXV6115VC6U Integrated Pressure Sensor, 8 pages on 8 sheets, 2009.

(Continued)

*Primary Examiner* — Richard L Chiesa
(74) *Attorney, Agent, or Firm* — The Patent Source

(57) ABSTRACT

Clean corona ionization bars separate contaminant byproducts from corona generated ions by establishing a non-ionized gas stream having a pressure and directed toward an attractive non-ionizing electric field of a charge neutralization target, by establishing a plasma region of ions and contaminant byproducts in which the pressure is sufficiently lower than the pressure of the non-ionized gas stream to prevent byproducts from migrating into the non-ionized gas stream. The ionization bar(s) may be located sufficiently close to the charged neutralization target that a non-ionizing electric field of the target induces at least a substantial portion of the ions to migrate into the non-ionized gas stream and to the neutralization target as a clean ionized gas stream.

34 Claims, 4 Drawing Sheets

U.S. PATENT DOCUMENTS

| | | | | |
|---|---|---|---|---|
| 5,847,917 | A * | 12/1998 | Suzuki | 361/213 |
| 6,373,680 | B1 | 4/2002 | Riskin | 361/231 |
| 6,563,110 | B1 | 5/2003 | Leri | 250/282 |
| 6,566,887 | B2 | 5/2003 | Smith et al. | 324/514 |
| 6,636,411 | B1 | 10/2003 | Noll | 361/213 |
| 6,646,856 | B2 | 11/2003 | Lee et al. | 361/232 |
| 6,693,788 | B1 | 2/2004 | Partridge | 361/231 |
| 6,807,044 | B1 | 10/2004 | Vernitskiy et al. | 361/230 |
| 6,850,403 | B1 | 2/2005 | Gefter et al. | 361/230 |
| 7,051,419 | B2 | 5/2006 | Scrom et al. | 29/854 |
| 7,120,007 | B2 | 10/2006 | Nakasone et al. | 361/231 |
| 7,208,030 | B2 | 4/2007 | Totoki | 96/19 |
| 7,356,987 | B2 | 4/2008 | Kiser et al. | 60/278 |
| 7,365,316 | B2 | 4/2008 | Miller et al. | 250/288 |
| 7,375,944 | B2 | 5/2008 | Izaki et al. | 361/230 |
| 7,697,258 | B2 * | 4/2010 | Vernitskiy et al. | 361/230 |
| 7,813,102 | B2 * | 10/2010 | Gefter et al. | 361/213 |
| 2004/0045442 | A1 * | 3/2004 | Ziya Ramizovich et al. | 96/94 |
| 2006/0187609 | A1 | 8/2006 | Dunn | 361/230 |
| 2006/0193100 | A1 | 8/2006 | Izaki et al. | 361/220 |
| 2006/0260928 | A1 | 11/2006 | Avnery et al. | 204/157.3 |
| 2006/0285269 | A1 | 12/2006 | Ohtsuka et al. | 361/225 |
| 2007/0006478 | A1 | 1/2007 | Kotsuji | 34/96 |
| 2007/0025771 | A1 | 2/2007 | Robles Flores et al. | 399/172 |
| 2007/0158578 | A1 * | 7/2007 | Vernitskiy et al. | 250/423 R |
| 2007/0181820 | A1 | 8/2007 | Hwang et al. | 250/396 R |
| 2008/0078291 | A1 | 4/2008 | Daukant | 95/69 |
| 2008/0130190 | A1 | 6/2008 | Shimada | 361/231 |
| 2008/0225460 | A1 * | 9/2008 | Gefter et al. | 361/213 |
| 2008/0232021 | A1 * | 9/2008 | Gefter et al. | 361/213 |
| 2009/0050801 | A1 | 2/2009 | Fedorov | 250/288 |
| 2010/0128408 | A1 | 5/2010 | Takayanagi | 361/213 |

FOREIGN PATENT DOCUMENTS

| | | | |
|---|---|---|---|
| JP | 2004362951 | 12/2004 | |
| JP | 2006-236763 A * | 9/2006 | |
| JP | 2006236763 | 9/2006 | 3/4 |
| JP | 2007048682 | 2/2007 | 3/4 |

OTHER PUBLICATIONS

Atmel Corporation datasheet for 8-bit AVR with 8K Bytes In-System Programmable Flash including data for ATMEGA8 microcontroller, 22 pages on 11 sheets, 2003.

Fox Valve Development Corp. Bulletin 401 A including data for Fox Mini-Eductors, 10 pages on 10 sheets, date unknown.

Anvers Corporation catalog, Section 3 (Air Powered Vacuum Generators & Accessories) including data for ANVERS JV-09 Series Mini Vacuum Generator, 88 pages on 44 sheets, date unknown.

United Filtration System Inc., disposable in-line filter datasheets including the DIF-MN50 filter, 6 pages on 6 sheets, Jan. 31, 2006.

PCT Application PCT/US01/01215, Notification of Transmittal of the International Search Report . . . International Search Report, and Written Opinion of the International Searching Authority mailed Jul. 9, 2010; 10 pages total.

Automated JPO/INPIT translation of JP 2004-273293 28 pages.

Automated JPO/INPIT translation of JP 2004-362951 29 pages.

Automated JPO/INPIT translation of JP 2007-048682 9 pages.

Automated JPO/INPIT translation of JP 2006-236763 10 pages.

PCT Application PCT/US2010/053741, Notification of Transmittal of the International Search Report . . . and associated International Search Report, mailed Dec. 22, 2010; 4 pages total.

PCT Application PCT/US2010/053741, Written Opinion of the International Searching Authority, mailed Dec. 22, 2010; 9 pages total.

PCT Application PCT/US2010/053996, Notification of Transmittal of the International Search Report . . . and associated International Search Report, mailed Dec. 23, 2010; 4 pages total.

PCT Application PCT/US2010/053996, Written Opinion of the International Searching Authority, mailed Dec. 23, 2010; 7 pages total.

PCT Application PCT/US2011/024010, Notification of Transmittal of the International Search Report . . . and associated International Search Report, mailed Apr. 6, 2011; 4 pages total.

PCT Application PCT/US2011/024010, Written Opinion of the International Searching Authority, mailed Apr. 6, 2011; 10 pages total.

* cited by examiner

SEPARATING CONTAMINANTS FROM GAS IONS IN CORONA DISCHARGE IONIZING BARS

CROSS REFERENCE TO RELATED CASES

This application claims the benefit under 35 U.S.C. 119(e) of co-pending U.S. Application Ser. No. 61/337,701, filed Feb. 11, 2010 and entitled "Separating Contaminants From Gas Ions In Corona Discharge Ionizers"; and is a continuation-in-part of U.S. application Ser. No. 12/799,369, filed Apr. 23, 2010, which, in turn, claimed priority from U.S. Provisional Application Ser. No. 61/214,519 filed Apr. 24, 2009 and entitled "Separating Particles and Gas Ions in Corona Discharge Ionizers"; U.S. Provisional Application Ser. No. 61/276,792 filed Sep. 16, 2009 and entitled "Separating Particles and Gas Ions in Corona Discharge Ionizers"; U.S. Provisional Application Ser. No. 61/279,784, filed Oct. 26, 2009 and entitled "Covering Wide Areas With Ionized Gas Streams"; and U.S. Provisional Application Ser. No. 61/337,701, filed Feb. 11, 2010 and entitled "Separating Contaminants From Gas Ions In Corona Discharge Ionizers", which applications are all hereby incorporated by reference in their entirety.

BACKGROUND OF THE INVENTION

1. Field of the Invention

The invention relates to the field of static charge neutralization apparatus using corona discharge for gas ion generation. More specifically, the invention is directed to producing clean ionized gas flows for charge neutralization in clean and ultra clean environments such as those commonly encountered in the manufacture of semiconductors, electronics, pharmaceuticals and similar processes and applications.

2. Description of the Related Art

Processes and operations in clean environments are specifically inclined to create and accumulate electrostatic charges on all electrically isolated surfaces. These charges generate undesirable electrical fields, which attract atmospheric aerosols to the surfaces, produce electrical stress in dielectrics, induce currents in semi-conductive and conductive materials, and initiate electrical discharges and EMI in the production environment.

The most efficient way to mediate these electrostatic hazards is to supply ionized gas flows to the charged surfaces. Gas ionization of this type permits effective compensation or neutralization of undesirable charges and, consequently, diminishes contamination, electrical fields, and EMI effects associated with them. One conventional method of producing gas ionization is known as corona discharge. Corona-based ionizers, (see, for example, published patent applications US 20070006478, JP 2007048682) are desirable in that they may be energy and ionization efficient in a small space. However, one known drawback of such corona discharge apparatus is that the high voltage ionizing electrodes/emitters (in the form of sharp points or thin wires) generate undesirable contaminants along with the desired gas ions. Corona discharge may also stimulate the formation of tiny droplets of water vapor, for example, in the ambient air.

The formation of solid contaminant byproducts may also result from emitter surface erosion and/or chemical reactions associated with corona discharge in an ambient air/gas atmosphere. Surface erosion is the result of etching or spattering of emitter material during corona discharge. In particular, corona discharge creates oxidation reactions when electronegative gasses such as air are present in the corona. The result is corona byproducts in form of undesirable gases (such as ozone, and nitrogen oxides) and solid deposits at the tip of the emitters. For that reason conventional practice to diminish contaminant particle emission is to use emitters made from strongly corrosive-resistant materials. This approach, however, has its own drawback: it often requires the use of emitter material, such as tungsten, which is foreign to the technological process, such as semiconductor manufacturing. The preferred silicon emitters for ionizers used to neutralize charge during the manufacture of semiconductor silicon wafers do not possess the desired etching and corrosive resistance.

An alternative conventional method of reducing erosion and oxidation effects of emitters in corona ionizers is to continuously surround the emitter(s) with a gas flow stream/sheath of clean dry air (CDA), nitrogen, etc. flowing in the same direction as the main gas stream. This gas flow sheath is conventionally provided by gas source of gas as shown and described in published Japanese application JP 2006236763 and in U.S. Pat. No. 5,847,917.

U.S. Pat. No. 5,447,763 Silicon Ion Emitter Electrodes and U.S. Pat. No. 5,650,203 Silicon Ion Emitter Electrodes disclose relevant emitters and the entire contents of these patents are hereby incorporated by reference. To avoid oxidation of semiconductor wafers manufacturers utilize atmosphere of electropositive gasses like argon and nitrogen. Corona ionization is accompanied by contaminant particle generation in both cases and, in the latter case, emitter erosion is exacerbated by electron emission and electron bombardment. These particles move with the same stream of sheath gas and are able to contaminate objects of charge neutralization. Thus, in this context the cure for one problem actually creates another.

There are some important differences between an AC in-line ionizer and an AC or DC/pulsed DC ionizers operating in the ambient air or gas: single emitter of the in-line ionizer is isolated from ambient atmosphere (or gas) and there is no electrical field from a charged object to affect an ionization cell.

In contrast, ambient ionizer emitter(s) "see" electrical field from charged object and this field participates in ion clouds movement. Moreover, the emitter(s) in the ambient ionizer is not isolated from ambient atmosphere or gas. Consequently, in the ambient ionizer vacuum flow alone does not solve the problem of emitter contamination. In fact, vacuum flow inside an ionizer could create a dragging effect (sucking) for a portion of the ambient air which could, in turn, lead to the accumulation of a type of debris around the emitter point known as a "fuzz ball".

SUMMARY OF THE INVENTION

The present invention may satisfy the above-stated needs and overcome the above-stated and other deficiencies of the related art by providing ultra clean ionizing bars that provide one or more of the following benefits (1) provide static neutralization of charged neutralization targets/objects without exposing the targets/objects to substantial numbers of particulate contaminants inevitably produced by corona discharge electrodes in the ionizing bar; (2) provide static neutralization of charged targets/objects without exposing the charged neutralization targets/objects to substantial amounts of byproduct gases (such as ozone, nitrogen oxides, etc.) due to chemical reactions inevitably produced by corona discharge of the ionizing bar; (3) prevent or decrease fuzz ball and/or other debris formation/contamination on corona discharge electrodes in the ionizing bar to thereby prolong the maintenance-free time of such corona discharge electrodes; and (4) improve ion delivery to the charge neutralization targets/objects by combination of air (gas) assist techniques and/or multi-frequency corona ionization techniques.

Ionizing bars in accordance with the invention may include a single shell assembly or, alternatively, plural shell assemblies with AC ionizing electrodes compatible with AC high voltage power supplies (HVPS). Alternatively, ionizing bars in accordance with the invention may include both dedicated positive electrodes compatible with positive DC HVPS and dedicated negative electrodes compatible with negative DC HVPS.

The present invention may take the form of an ionizing bar for directing a clean ionized gas stream to an attractive non-ionizing electric field of a charge neutralization target. Inventive ionizing bars may receive a non-ionized gas stream, exhaust a contaminant gas stream away from a charge neutralization target, and receive an ionizing electrical potential sufficient to induce corona discharge at plural electrodes. An inventive ionizing bar may include at least one gas channel that receives the non-ionized gas stream and that directs the clean ionized gas stream toward the target and at least one evacuation-channel that exhausts the contaminant gas stream away from the ionizing bar and target. An inventive ionizing bar may also include plural shell assemblies, each of which includes a shell, at least one ionizing electrode and at least one evacuation port. The shell may have an orifice in gas communication with the shell and the gas channel such that a portion of the non-ionized gas stream may enter the shell. The ionizing electrode may have a tip that produces a plasma region, comprising ions and contaminant byproducts, in response to application of the ionizing electrical potential. The ionizing electrode may be disposed within the shell such that the tip is recessed from the shell orifice by a distance that is at least generally equal to the size of the plasma region whereby at least a substantial portion of the produced ions migrate into the non-ionized gas stream to thereby form the clean ionized gas stream that is drawn toward the charge neutralization target by the non-ionizing electric field. The ionizing electrode also may be configured as a stretched thin wire or saw-tooth band. The evacuation port may be in gas communication with the evacuation-channel and may present a gas pressure within the shell and in the vicinity of the orifice that is lower than the pressure of the non-ionized gas stream outside the shell and in the vicinity of the orifice, whereby a portion of the non-ionized gas stream flows into the shell and sweeps at least a substantial portion of the contaminant byproducts into the contaminant gas stream exhausted by the evacuation-channel.

In a related form, the invention may be directed to an ionizing bar that directs a clean ionized gas stream toward an attractive non-ionizing electric field of a charge neutralization target. This inventive ionizing bar receives a non-ionized gas stream, exhausts a contaminant gas stream away from the charge neutralization target, receives a positive ionizing electrical potential sufficient to induce corona discharge at a positive ionizing electrode, and receives a negative ionizing electrical potential sufficient to induce corona discharge at a negative ionizing electrode. The invention may take the form of an ionizing bar with at least one gas channel that receives the non-ionized gas stream and that directs the clean ionized gas stream toward the charge neutralization target and with at least one evacuation-channel that exhausts the contaminant gas stream from the ionizing bar and away from the charge neutralization target.

In this form, an inventive ionizing bar may also include at least one positive shell assembly with a positive shell having an orifice in gas communication with the gas channel such that a portion of the non-ionized gas stream may enter the positive shell, and with at least one positive ionizing electrode with a tip that produces a plasma region, comprising ions and contaminant byproducts, in response to application of the positive ionizing electrical potential, the positive electrode being disposed within the positive shell such that the tip is recessed from the shell orifice by a distance that is at least generally equal to the size of the plasma region whereby at least a substantial portion of the produced ions migrate into the non-ionized gas stream to thereby form the clean ionized gas stream that is drawn toward the charge neutralization target by the non-ionizing electric field. The positive shell assembly may also include at least one evacuation port, in gas communication with the evacuation-channel and the shell, that presents a gas pressure within the positive shell and in the vicinity of the orifice that is lower than the pressure of the non-ionized gas stream outside the positive shell and in the vicinity of the orifice, whereby a portion of the non-ionized gas stream flows into the positive shell and sweeps at least a substantial portion of the contaminant byproducts into the contaminant gas stream exhausted by the evacuation-channel.

In this form, an inventive ionizing bar may further include at least one negative shell assembly with a negative shell having an orifice in gas communication with the gas channel such that a portion of the non-ionized gas stream may enter the negative shell, and with at least one negative ionizing electrode with a tip that produces a plasma region, comprising ions and contaminant byproducts, in response to application of the negative ionizing electrical potential. The negative electrode may be disposed within the negative shell such that the tip is recessed from the shell orifice by a distance that is at least generally equal to the size of the plasma region whereby at least a substantial portion of the produced ions migrate into the non-ionized gas stream to thereby form the clean ionized gas stream that is drawn toward the charge neutralization target by the non-ionizing electric field. The negative shell assembly may further include at least one evacuation port, in gas communication with the evacuation-channel and the shell, that presents a gas pressure within the negative shell and in the vicinity of the orifice that is lower than the pressure of the non-ionized gas stream outside the negative shell and in the vicinity of the orifice, whereby a portion of the non-ionized gas stream flows into the negative shell and sweeps at least a substantial portion of the contaminant byproducts into the contaminant gas stream exhausted by the evacuation-channel.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1A:
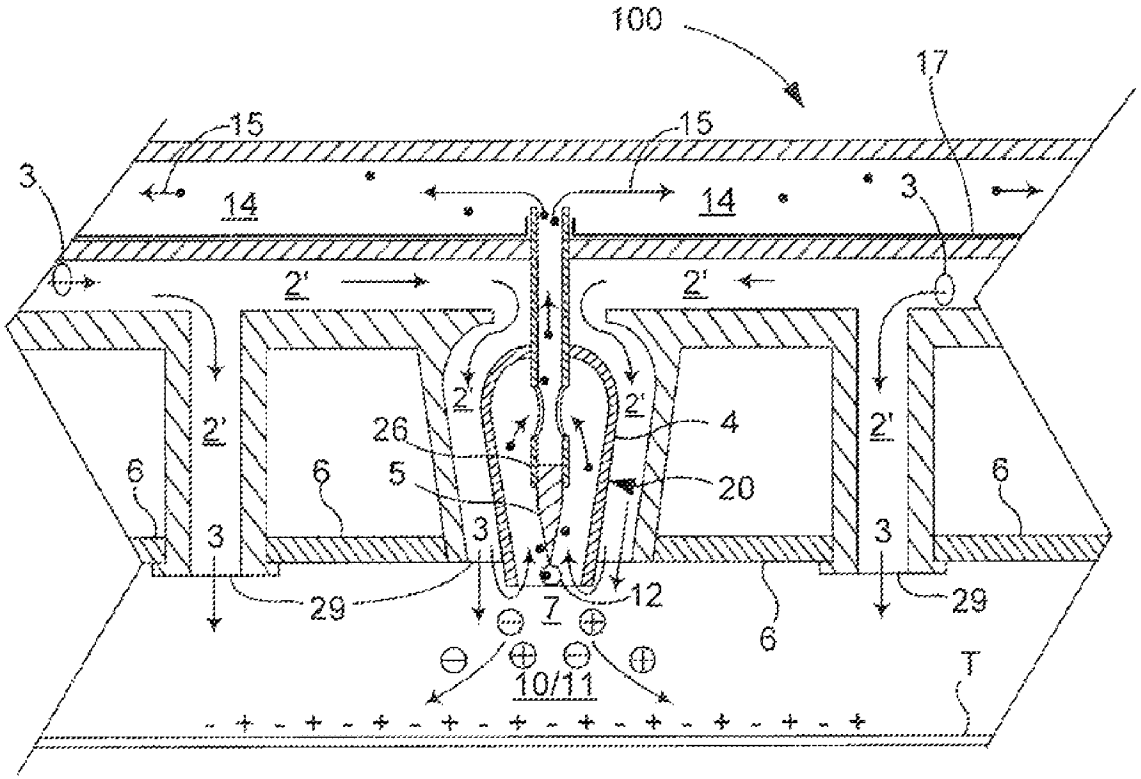
FIG. 1*a* is a portion of an ionizing bar in accordance with one preferred embodiment of the present invention shown in conjunction with a portion of a charge neutralization target/object.

The inventive concept of a preferred ultra-clean AC corona ionizing bar 100 is illustrated in the fragmented cross-sectional view of FIG. 1*a*. As shown therein, a preferred linear ionizing bar 100 may comprise a plurality of linearly disposed shell assemblies 20 (each having an emitter 5 and a shell 4) which may be separated by a plurality of nozzles/ports 29 that are in gas communication with a non-ionized air/gas channel 2' and that are directed toward a charged neutralization target/object T. Air/gas port(s)/nozzle(s) 29 may assist with the delivery of charge carriers 10/11 toward charged target/object T. Additionally, ionizing bar 100 may contain a low-pressure evacuation channel 14. Evacuation channel 14 may be connected to an in-tool/production vacuum line (not shown), to a built-in vacuum source (not shown), or to any of the many similar arrangements known in the art that may maintain a pressure that is lower than the gas pressure in the vicinity of the emitter shell orifice 7 as well as the gas pressure external to emitter shell 4. Channel 2' may be connected to a source of high-pressure gas (not shown) that may supply a stream of clean-gas 3 to channel 2' at a volume in the range of about 0.1 to 20.00 liters/min per ionizer and/or non-ionization nozzle/orifice/jet 29/29'. However, rates in the range of about 0.1 to 10.00 liters/min are most preferred. The gas may be CDA (clean dry air) or nitrogen (or another electropositive gas), or to any of the many similar arrangements (such as a high-cleanliness gas (e.g., nitrogen) source) known in the art.

At least one high-voltage bus 17 may be positioned, for example, on the lower wall of vacuum/evacuation channel 14 which is preferably non-conductive at least in the portions adjacent to bus 17. Bus 17 is preferably in electrical communication with a tube 26 which may take the form of a hollow conductive tube and may serve at least two functions: to provide electrical communication with emitter 5 and to exhaust low-pressure byproduct flow (containing corona-generated contaminants) from the emitter shell 4. Tube 26 may have one open end that terminates in vacuum channel 14 and another end that forms a holding socket within which a corona discharge electrode/emitter 5 may be received. Tube 26 may be formed partially or entirely of electrically conductive or semi-conductive material and also in electrical communication with ionizing electrode 5 such that an ionizing voltage applied to bus 17 will also be received by emitter 5. Gas ionization starts when an AC voltage output from a high voltage power supply (HVPS—not shown) exceeds the corona threshold for the emitter 5. As known in the art, this results in the production of positive and negative ions 10, 11 by AC (or, in alternate embodiments discussed below, DC or pulsed DC) corona discharge in a generally spherical plasma region 12 in the vicinity of and generally emanating from the emitter tip. This corona discharge also results in the production of undesirable contaminant byproducts 15. It will be appreciated that, were it not for protective emitter shell 4, byproducts 15 would continuously move toward target/object T due to ionic wind, diffusion, and electrical repulsion forces emanating from the tip of emitter 5. Thus, contaminant byproducts 15 would be swept into the non-ionized gas stream 3 (along with newly created ions) and directed toward the charge neutralization target object T and the target object would be contaminated (compromising the goal of clean charge neutralization).

Due to the presence of emitter shell 4 and lower gas pressure presented by evacuation channel 14, however, the gas flow pattern within and/or in the vicinity of plasma region 12 produced by emitter 5 prevents contaminants 15 from entering the gas stream 3. In particular, the configuration shown in FIG. 1*a* creates a pressure differential between the non-ionized gas stream in the vicinity of orifice 7 and plasma region 12 (within shell 4). Because of this pressure differential, a portion of high velocity gas flow 3 seeps from channel 2', through orifice 7 and into shell 4. This gas stream creates a drag force that induces substantially all of corona-generated byproducts 15, from plasma region 12, into evacuation port 14. Those of ordinary skill will appreciate that byproducts 15 are subject to the same ionic wind, diffusion, and electrical forces that urge ions 10, 11 into the main gas stream as discussed above. However, the present invention is intended to create conditions under which the gas stream portion is strong enough to overcome such opposing forces. As a consequence, ions 10 and 11, and byproducts 15 are aerodynamically and electrically separated and move in different directions: positive and negative ions 10, 11 into the non-ionized gas stream to thereby form an ionized gas stream flowing downstream toward the charged object T. By contrast, byproducts 15 are evacuated and/or swept toward evacuation port 14 and, preferably, to byproduct collector, filter or trap (not shown).

With further reference to FIG. 1*a*, tube 26 may have at least one opening(s)/aperture(s) near the emitter-socket end thereof and in close proximity to emitter 5. As shown, emitter 5 and the emitter-socket end of tube 26 are preferably positioned inside of a hollow shell 4 and discharge end of emitter 5 is spaced inwardly of (or, synonymously, recessed from) orifice 7 by distance R (see, e.g., FIG. 1*b*). The greater the recess distance R, the more easily contaminant byproducts from plasma region 12 might be swept toward evacuation channel 14 by a low-pressure evacuation flow. It has been determined that a low pressure gas flow through channel in the range of about 0.1 to about 20 liters/min may be adequate for this purpose. Most preferably, the flow may be about 1-10 liters/min per ionizer or ionizing assembly to reliably evacuate a wide range of particle sizes (for example, 10 nanometers to 1000 nanometers). However, the smaller the recess distance R, the more easily ions from plasma region 12 might migrate through orifice 7 and into the ion drift region of main gas stream 2 as desired. For optimum balance of these competing considerations, it has been determined that optimum ion/byproduct separation may be achieved if the distance R is selected to be at least generally and preferably substantially equal to the size of plasma region 12 produced by corona discharge at the tip of emitter 5 (plasma region is usually about 1 millimeter across). In addition, the preferred distance R may be generally comparable to the diameter D of the circular orifice 7 (in the range of about 2 millimeters to 3 millimeters). Most preferably, the D/R ratio may range from about 0.5 to about 2.0.

With continuing reference to FIG. 1*a*, those of ordinary skill in the art will readily appreciate that the ionizing bar 100 shown therein contains directional arrows representing the two primary gas flows moving therethrough: a gas flow 3 which moves around shell 4 to thereby urge charge carriers 10/11 toward target/object T; and a low-pressure suction/vacuum flow 15 which draws contaminant gases and particles through evacuation channel 14 due to the pressure differential between vacuum channel 14 and ambient environment. In this way, low-pressure suction/vacuum flow 15 at least substantially isolates the tip of emitter 5 from the ambient environment. Moreover, and as noted above, suction/vacuum flow 15 entrains solid contaminant particles and other corona byproducts/gases and delivers them through tube 26 and into vacuum channel 14 (and, importantly, away from target/object T).

In practice, the relationship between the magnitude of gas flow 3 and the magnitude of gas/particle flow 15 (for example, the gas flow ratio 3/15) is important in defining cleanliness of the ionizer and the ion delivery efficiency. And this gas flow ratio may be varied to achieve optimized performance under various circumstance/applications. For example, if charged target/object is positioned in close proximity to ionizing bar 100 (as is often the case in semiconductor fabrication applications), the velocity of gas flow 3 should be limited, for example, from about 75 ft/min to about 100 ft/min.

At a certain gas flow ratio 3/15, plasma region 12 of ion emitter(s) 5 may be isolated from the ambient atmosphere so debris build-up on tip of emitter 5 is largely inhibited and substantially all of the corona-generated contaminant byproducts are removed. So, in some most-preferred embodiments, both of gas flows 3 and 15 (and, in particular, the gas flow ratio 3/15) may be adjusted depending on various factors (such as the distance between ionization assemblies 20 and the charged target/object T) to thereby manage contaminant byproduct movement.

By contrast, if the charged neutralization target/object T is positioned further away from ionizing bar 100, gas flow 3 should be increased because, under these conditions, the electrical field presented by the charged object/target T, will be weaker (i.e., lower electric field intensity will be present at the ionizing bar) and ion delivery will be provided mainly by air/gas flow 3. However, flow 3 must not be so large as to permit contaminant particles 15 to escape from plasma space 12 and flow toward target/object T.

Referring again to FIG. 1*a*, and as noted above, when used with an AC power supply, ionizing bar 100 may include optional reference electrode(s) 6 to (1) facilitate ion generation at the tip of emitter 5, and (2) provide an electrical field for moving charge carriers 10/11 away from the tip of emitter 5. Electrically insulated reference electrode 6 is preferably disposed as a generally planar face that forms one outer surface of ionizing bar 100 to thereby present a relatively low intensity (non-ionizing) electric field at, and in addition to the ionizing electric field that formed the plasma regions 12.

The electrical potential received by emitter 5 may be in the range of about 3 kilovolts to about 15 kilovolts and is typically about 9 kilovolts. The electrical potential received by the reference electrode 6 may be in the range of about 0 volts to about 1000 volts, with about 30 volts being most preferred. Where the non-ionized gas is air, this non-ionizing voltage may swing below zero volts. It is noted that a radio-frequency ionizing potential is preferably applied to ionizing electrode 5 through a capacitor. Similarly, the reference electrode may be "grounded" through a capacitor and inductor (a passive LC circuit) from which a feedback signal can be derived. This arrangement, thus, presents an electric field between ionizing electrode 5 and non-ionizing electrode 6. When the potential difference between electrodes is sufficient to establish corona discharge, a current will flow from emitter 5 toward reference electrode 6. Since emitter 5 and reference electrode 6 are both isolated by capacitors, a relatively small DC offset voltage is automatically established and any transient ionization balance offset that may be present will diminish to a quiescent state of about zero volts.

As an alternative, ion cloud movement to the charged object could be provided by another gas flow from dedicated nozzles 29 (see also nozzles 29' with velocity caps in FIG. 2*a*) which are positioned near and/or between the ionizing shell assemblies 20. Nozzles 29 may be in gas communication with high-pressure/clean-gas channel 2' and the cross-sectional area of each nozzle 29 is preferably significantly smaller than the cross-sectional area of each shell orifice 7. As a result, each nozzle 29 is able to create higher-speed gas streams (as compared with the shell assemblies), efficiently entrain the ambient air, harvest (collect) ions, and move them to distant (for example, 1000 mm or more) charged targets/objects T. In this way, gas flow from nozzles 29 help to deliver ions to the charged neutralization targets/objects 1' to, thereby, significantly increase the efficiency of the ionizer. This concept was disclosed in U.S. Pat. No. 7,697,258, filed Oct. 6, 2006, issued Apr. 13, 2010 and entitled, "Air Assist For AC Ionizers", the entire contents of which are hereby incorporated by reference. The present invention is compatible with the invention(s) disclosed in U.S. Pat. No. 7,697,258 as described immediately above.

Figure 1D:
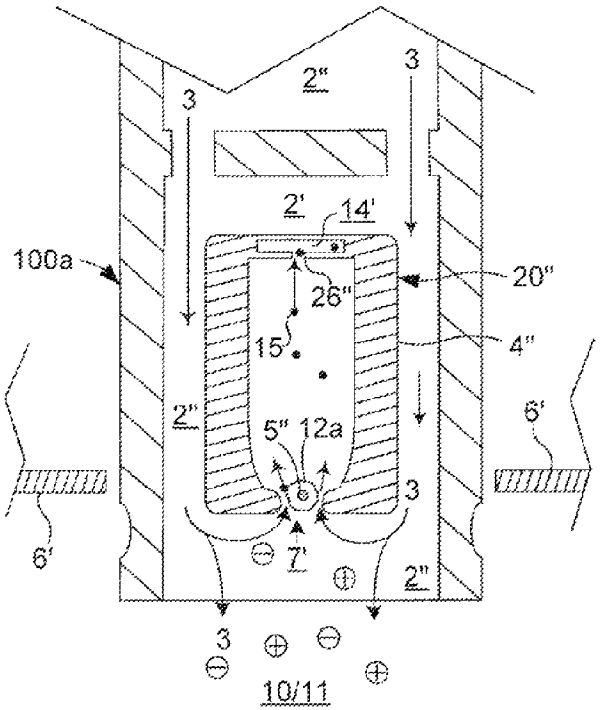
FIG. 1*d* is a cross-sectional view of still another preferred ionizing bar, with the bar extending out of the plane of the page and with the cross-section being taken through a shell assembly with still another variant design.
Figure 1B:
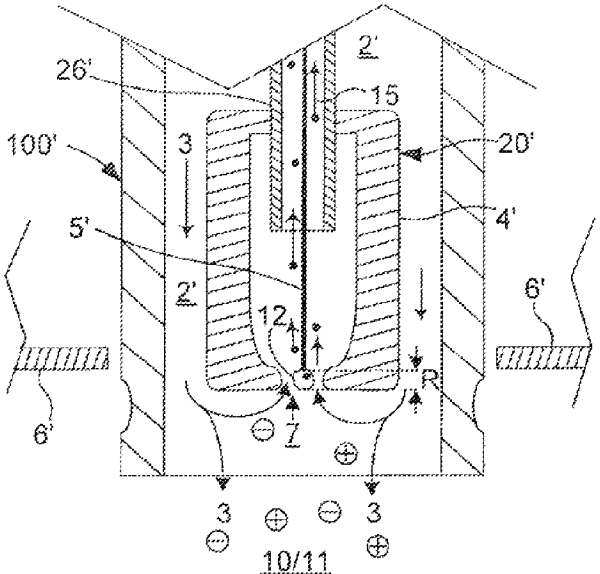
FIG. 1*b* is a cross-sectional view of another preferred ionizing bar, with the bar extending out of the plane of the page and with the cross-section being taken through a shell assembly with a variant design.
Figure 1C:
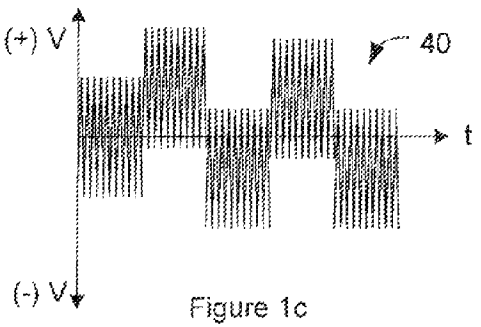
FIG. 1*c* shows a representative radio frequency AC ionizing electrical potential that may be applied to the ionizing electrode(s) depicted in the embodiments of FIGS. 1*a*, 1*b* and 1*d;*

Multi-frequency high voltage waveforms may be applied to the inventive ionizing bars disclosed herein as the ionizing electrical potential and a representative example of such a waveform is shown in FIG. 1*c*. Waveforms of this nature are disclosed in detail in U.S. Pat. No. 7,813,102, filed Mar. 14, 2008, issued Oct. 12, 2010 and entitled "Prevention Of Emitter Contamination With Electronic Waveforms", the entire contents of which are hereby incorporated by reference. In accordance with these teachings, a high-frequency AC voltage component (12-15 kHz) provides efficient ionization when the amplitude of the signal is approximately equal to the corona threshold voltage of the ionizing electrode(s) (the lowest possible voltage). This also decreases emitter erosion as well as the rate of corona byproduct generation. Moreover, high-frequency ionization neutralizes possible charges of solid particles and walls of the emitter shell. Also in accordance with the teachings of the aforementioned U.S. Pat. No. 7,813,102, the ionizing electrical potential may have a low frequency component that "polarizes" or "pushes" ions toward a target. The voltage amplitude of this component is generally a function of the distance between an ionizing electrode and the target. In this way, electrical (and inherent diffusion) forces induce at least a substantial portion of ions 10, 11 to migrate from plasma region 12 out of shell 4 (through outlet orifice 7 and toward target/object T while also moving laterally in the direction of reference electrode 6). Since the intensity of the electrical field is low in proximity to electrode 5, ions 10, 11 are swept into main (non-ionized) gas stream 3 (to, thereby form a clean ionized gas stream) and directed toward a neutralization target surface or object T. Accordingly, some embodiments of the present invention may use both as flow and a low frequency component of an AC ionizing potential to urge ions to move from the ionizer to a charged neutralization target. Further options for providing ionizing electrical potentials compatible with the invention described herein may be found in U.S. patent application Ser. No. 12/925,360, filed Oct. 20, 2010 and entitled "Self-Balancing Ionized Gas Streams", the entire contents of which are hereby incorporated by reference.

Although ionizing electrode 5 is preferably configured as a tapered pin with a sharp point, it will be appreciated that many different emitter configurations known in the art are suitable for use in the ionization shell assemblies in accordance with the invention. Without limitation, these may include: points, small diameter wires, wire loops, etc. Further, emitter 5 may be made from a wide variety of materials known in the art, including metals and conductive and semi-conductive non-metals like silicon, single-crystal silicon, polysilicon, silicon carbide, ceramics, and glass (depending largely on the particular application/environment in which it will be used).

Channels 2' and 14 may be made from a wide number of known metallic and non-metallic materials (depending on the particular application/environment in which it will be used) which may include plasma resistive insulating materials such as polycarbonate, Teflon® non-conductive ceramic, quartz, or glass. Alternatively, limited portions of the channels may be made from the aforementioned materials as desired. As another optional alternative, some or all of the channels 2' and/or 14 may be coated with a skin of plasma resistive insulating material as desired.

Emitter shells 4 may be made from a wide number of known metallic and non-metallic materials (depending on the particular application/environment in which it will be used) which may include plasma resistive insulating materials such as polycarbonate, Teflon® non-conductive ceramic, quartz, or glass. Alternatively, only the portion of the shell in the vicinity of the shell orifice may be made from the aforementioned materials. As another optional alternative, some or all of the emitter shells 4 may be coated with a skin of plasma resistive insulating material.

Turning now to FIG. 1*b*, there is shown therein a portion of an ultra-clean ionizing bar in accordance with a related preferred embodiment of the present invention that helps to illustrate a number of equivalent design variations. As shown in FIG. 1*b*, ionizing bar 100' may have some physical characteristics similar to that of ionizing bar 100 of FIG. 1*a* (as indicated by the use of like reference numerals) and the principle of operation of this embodiment is the same as that discussed above. Accordingly, the discussion of bar 100 above also applies to bar 100' except for the differences discussed immediately below. A first difference shown in FIG. 1*b* is that the walls of channel 2' and of shell 4' are slightly different than those shown in FIG. 1*a*. Further, as a matter of design choice gaps have been added between the wall of channel 2' and reference electrode 6'. Additionally, an ionizing wire 5' (which is not in electrical communication with tube 26' but is in electrical communication with an ionizing high-voltage power supply) has replaced tapered pin 5. Further, tube 26' may be formed of an insulating material since ionizing wire 5' does not receive an ionizing potential from tube 26'. Wire 5' may be axially aligned (and, thus, concentric) with tube 26' and tube 26' may be generally "straw-shaped" to provide a generally circular aperture in the vicinity of the plasma region 12. Naturally, byproducts 15 may flow into this aperture and, thereby, be delivered to an evacuation channel via an opposite end of tube 26'.

In another alternative embodiment shown in FIG. 1*d*, a slot ionization bar 100*a* may have only one elongated shell assembly 20" with one ionizing electrode comprising an elongated (substantially linear) corona wire 5" that is positioned within an elongated shell 4" with an evacuation port 26" and that produces a generally cylindrical plasma region 12*a*, comprising charge carriers 10/11 and contaminant byproducts, when presented with an ionizing electrical potential. The elongated shell 4" may have a shell orifice 7' (such as a slot) that is elongated in a direction that is at least generally parallel to the corona wire 5" (out of the plane of the page). As with the other embodiments discussed herein, this embodiment may also include a gas channel 2" (such as a larger, elongated high-pressure channel) that surrounds the elongated shell 4" such that a small portion of the clean gas 3 passing therethrough may enter the elongated shell to sweep contaminants 15 through the evacuation port 26" and into evacuation channel 14'. Naturally, a substantial portion of the corona-generated ions 10/11 will still enter the non-ionized gas stream 3 to form a clean ionized gas stream directed to a target as discussed with respect to other embodiments. The use of one or more reference electrode(s) 6' is optional and within the skill of the ordinary artisan based on the description provided throughout. In a variant of this embodiment, a substantially linear and elongated corona saw-blade (not shown) may be substituted for the corona wire 5" as an equivalent design choice within the skill of an ordinary artisan.

Turning now to FIG. 1*c*, there is shown a representative radio-frequency AC ionizing electrical potential 40 that may be applied to the ionizing electrode(s) depicted in the embodiments of FIGS. 1*a* and 1*b*. AC ionizing signal 40 may preferably have a radio-frequency component with an amplitude of about 3 kV to about 15 kV and a preferred frequency of about 12 kHz. AC ionizing signal 40 may preferably also have a low-frequency AC (pushing) component with an amplitude of about 100V to about 2 kV and a preferred frequency of between 0.1 Hz to about 100 Hz. As is known in the art, ionizing signals of this general nature not only cause ionization to occur, but may also help to "push" generated ions out of the plasma region and in a desired direction.

Figure 2A:
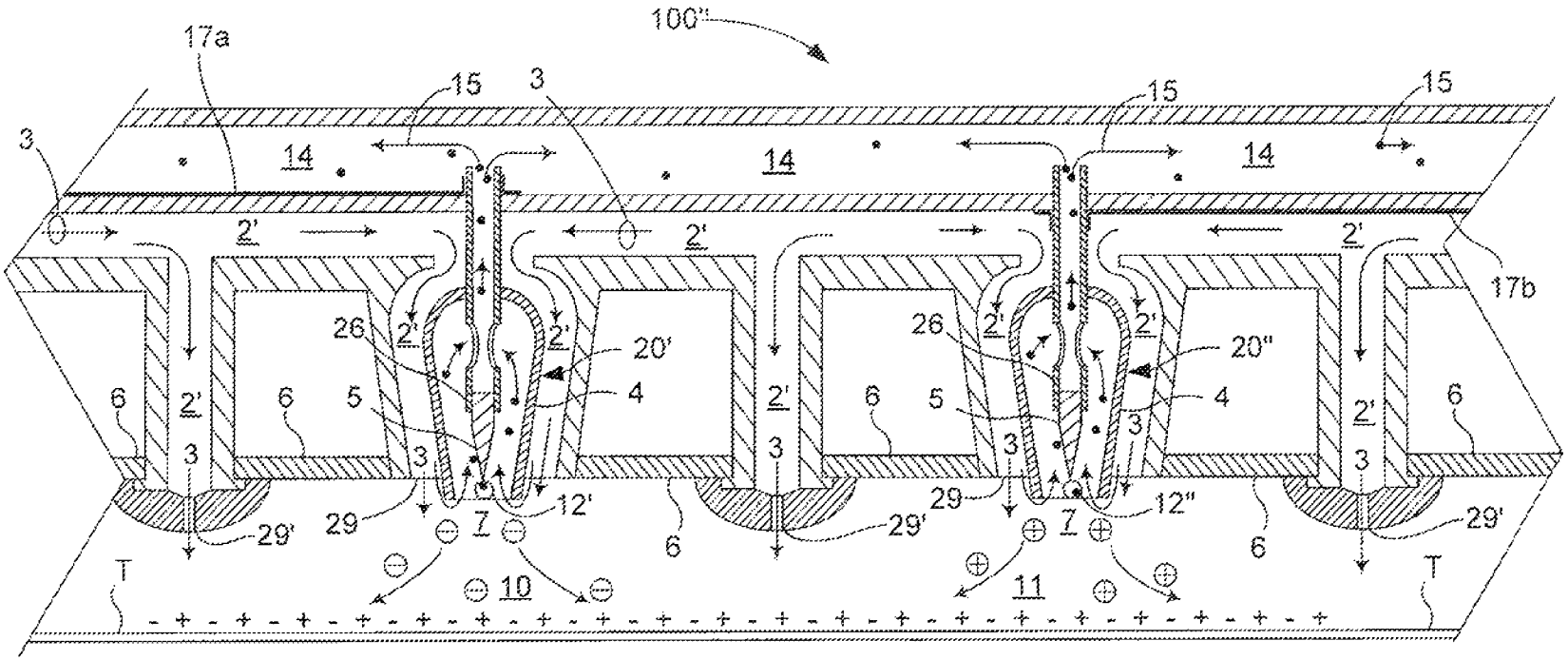
FIG. 2*a* depicts a portion of an ionizing bar in accordance with another preferred embodiment of the present invention shown in conjunction with a portion of a charge neutralization target/object.

Another preferred embodiment of the inventive ultra-clean ionizing bars may be configured to work in either DC or in pulsed DC modes of operation. As shown in FIG. 2*a*, ultra-clean ionizing bar 100" may have a physical configuration similar to that of ionizing bars 100 and 100' of FIGS. 1*a* and 1*b* (as indicated by the use of like reference numerals). Accordingly, the discussion of bars 100 and 100' above also applies to bar 100" except for the differences discussed immediately below. As shown in FIG. 2*a*, bar 100" may have at least two shell assemblies (with dedicated positive and negative emitters, respectively) 20' and 20" in electrical communication with positive and negative high-voltage buses 17*b* and 17*a*, respectively. Buses 17*a* and 17*b* may be positioned on nonconductive portions of high-pressure/clean-gas channel 2' and/or evacuation channel 14. Those of ordinary skill in the art will readily appreciate (in light of the disclosure contained herein) that ionizing bar 100" does not require any non-ionizing reference electrodes. That is because the positive and negative shell assemblies 20" and 20' are arranged in pairs of opposing polarity that induce corona-generated ion clouds to move laterally between these positive and negative shell assemblies. Thus, it is to be understood that the presence of reference electrodes 6 as shown in FIG. 2*a* is purely optional and the reason for this is explained further in the paragraph below.

In a most preferred embodiment plural pairs of positive and negative shell assemblies 20" and 20' are positioned along the ionizing bar 100" such that every other shell assembly is a negative shell assembly and such that all of the shell orifices at least generally face the charge neutralization target. In this configuration the ionizing electrical potential applied to the positive ionizing electrodes impose a non-ionizing electric field to the plasma region 12' of the negative shell assemblies 20' sufficient to induce at least a substantial portion of the negative ions 10 to migrate into the non-ionized gas stream. In this regard, it is noted that, as is known in the art, ion recombination rates of about 99% are common and, therefore, even less than 1% of ions may be considered a substantial portion of the ions produced given the context. Likewise, the ionizing electrical potential applied to the negative ionizing electrodes impose a non-ionizing electric field to the plasma region 12" of the positive shell assemblies 20" sufficient to induce at least a substantial portion of the positive ions to migrate into the non-ionized gas stream.

As known in the art, positive emitters are prone to create more contaminant particles and debris due to emitter erosion than are negative emitters. In accordance with certain DC or pulsed DC embodiments of the invention, vacuum flow 15 for positive shell assemblies 20" (or the gas flow ratio 3/15) should preferably be higher than for negative shell assemblies 20' so that contaminant removal may occur at unequal rates and in proportion to the rate of contaminant creation in the different types of shell assemblies 20' and 20".

Figure 2B:
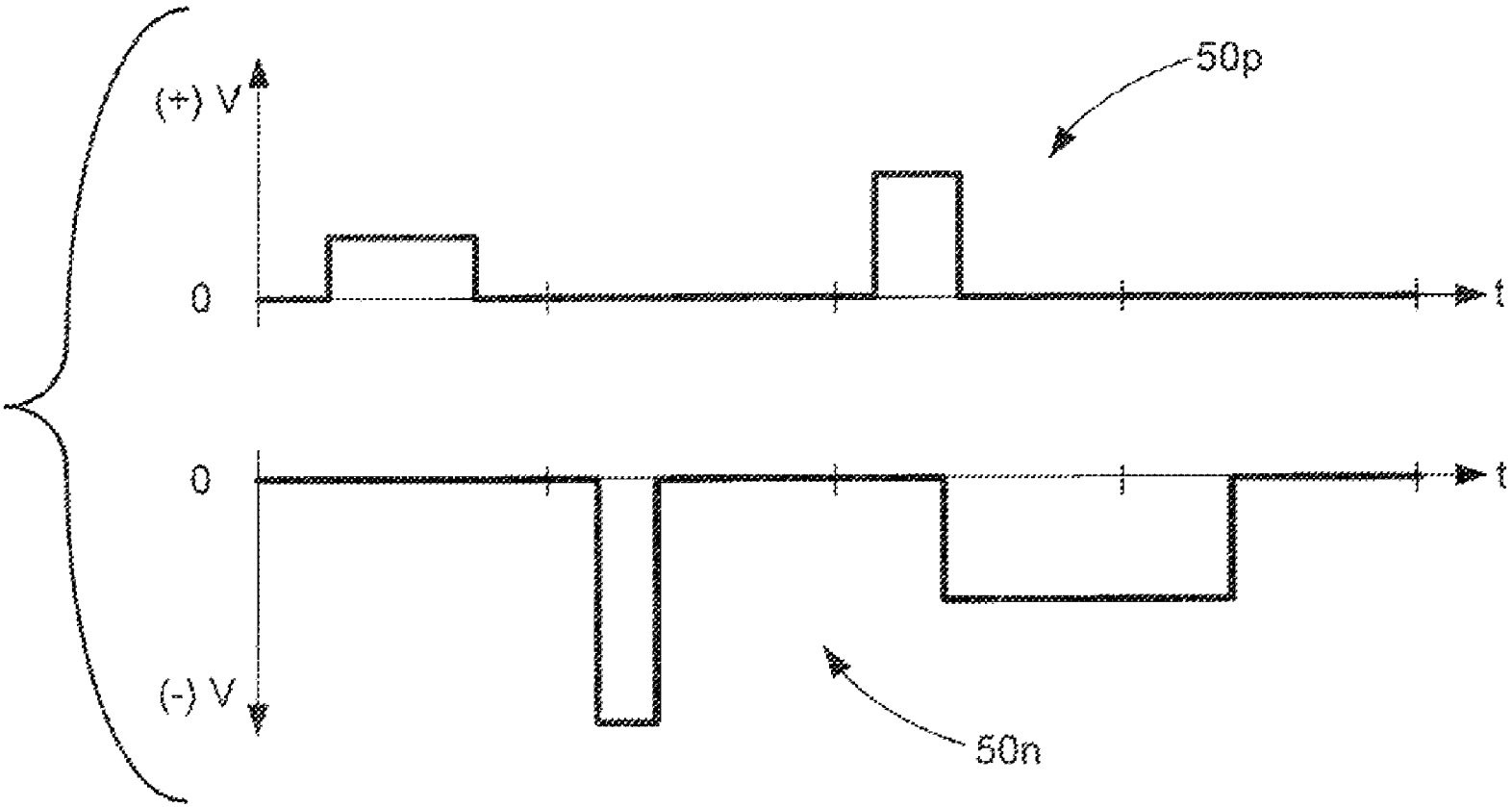
FIG. 2*b* shows representative pulsed DC ionizing electrical potentials that may be applied to the ionizing electrode(s) depicted in the embodiment of FIG. 2*a*.

Representative examples of pulsed DC (positive and negative) ionizing waveforms (50*p* and 50*n*, respectively) that may be applied to ionizing bar 100" are depicted in FIG. 2*b*. As indicated by representative waveforms 50*p* and 50*n*, voltage amplitude, pulse frequency and/or duration may be varied as appropriate to deliver balanced positive and negative ion clouds to the target/object in any given application. Moreover, high-voltage pulses may be synchronized with vacuum and/or variable upstream gas flow to increase ionizer efficiency and minimize particle generation/debris build-up. As applied to the preferred embodiment of FIG. 2*a*, positive pulsed DC signal 50*p* would be presented to shell assembly 20' via bus 17*a* and negative pulsed DC signal 50*n* would be presented to shell assembly 20" via bus 17*b*. For each of signals 50*p* and 50*n*, conventional pulsed DC amplitude ranges and frequency ranges may be used. By way of example only, the amplitude of signals 50*p* and 50*n* may be about 3 kV to about 15 kV and the frequency of signals 50*p* and 50*n* may be about 0.1 Hz to about 200 Hz. As is known in the art, ionizing signals of this general nature not only cause ionization to occur, but may also help to "push" generated ions out of the plasma region and in a desired direction.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

What is claimed is:

1. An ionizing bar that directs a clean ionized gas stream toward an attractive non-ionizing electric field of a charge neutralization target, the ionizing bar receiving a non-ionized gas stream, exhausting a contaminant gas stream away from the charge neutralization target, and receiving an ionizing electrical potential sufficient to induce corona discharge at plural electrodes, the ionizing bar comprising:

at least one gas channel that receives the non-ionized gas stream and that directs the clean ionized gas stream toward the charge neutralization target;

at least one evacuation-channel that exhausts the contaminant gas stream from the ionizing bar and away from the charge neutralization target; and plural shell assemblies, each shell assembly comprising:

a shell having an orifice in gas communication with the gas channel such that a portion of the non-ionized gas stream enters the shell;

at least one ionizing electrode that produces a plasma region, comprising ions and contaminant byproducts, in response to application of the ionizing electrical potential, the ionizing electrode being disposed within the shell such that the electrode is recessed from the shell orifice by a distance that is at least substantially equal to the size of the plasma region whereby at least a substantial portion of the produced ions migrate into the non-ionized gas stream to thereby form the clean ionized gas stream that is drawn toward the charge neutralization target by the non-ionizing electrical field; and at least one evacuation port, in gas communication with the evacuation-channel and the shell, that presents a gas pressure within the shell and in the vicinity of the shell orifice that is lower than the pressure of the non-ionized gas stream outside the shell and in the vicinity of the orifice, whereby a portion of the non-ionized gas stream flows into the shell and sweeps at least a substantial portion of the contaminant byproducts into the contaminant gas stream exhausted by the evacuation-channel.

2. The ionizing bar of claim 1 wherein the ionizing electrode comprises a tapered pin with a sharp point facing the shell orifice; and the evacuation port comprises a conductive hollow socket within which the tapered pin is seated such that the ionizing electrical potential may be applied to the pin through the evacuation port.

3. The ionizing bar of claim 1 wherein the ionizing electrical potential is a radio-frequency electrical potential that periodically exceed both the positive and negative corona threshold of the ionizing electrode whereby the plasma region is substantially electrically balanced and the byproducts are substantially neutralized.

4. The ionizing bar of claim 1 wherein at least a substantial portion of the byproducts are gases evacuated through the evacuation port and selected from the group consisting of ozone and nitrogen oxides.

5. The ionizing bar of claim 1 wherein the ionizing electrical potential is a radio-frequency electrical potential that periodically exceed both the positive and negative corona threshold of the ionizing electrode whereby the ionizing electrode produces both positive and negative ions.

6. The ionizing bar of claim 1 wherein the shell orifice is generally circular and has a diameter; and the ratio of the shell orifice diameter and the recess distance is between about 0.5 and about 2.0.

7. The ionizing bar of claim 1 wherein the ionizing electrode is made of a material selected from the group consisting of metallic conductors, non-metallic conductors, semiconductors, single-crystal silicon and polysilicon; and the evacuation port is connected to a source of low pressure and provides gas flow in the shell in the range of about 1-20 liters per minute to thereby evacuate at least a substantial portion of the byproducts.

8. The ionizing bar of claim 1 wherein the non-ionized gas is an electropositive gas;

the ionizing potential is a radio-frequency ionizing electrical potential; and the ionizing electrode produces a plasma region comprising electrons, positive and negative ions and byproducts.

9. The ionizing bar of claim 1 wherein the gas channel further comprises plural nozzles disposed between adjacent ones of the shell assemblies and through which non-ionized gas may be directed toward the charge neutralization target to thereby urge the ionized gas stream toward the charge neutralization target.

10. The ionizing bar of claim 1 further comprising at least one non-ionizing electrode for superimposing, into the plasma region, a non-ionizing electric field that induces at least a substantial portion of the ions to migrate through the shell orifice and into the non-ionized gas stream that is directed toward the charge neutralization target.

11. An ionizing bar that directs a clean ionized gas stream toward an attractive non-ionizing electric field of a charge neutralization target, the ionizing bar receiving a non-ionized gas stream, exhausting a contaminant gas stream away from the charge neutralization target, and receiving an ionizing electrical potential sufficient to induce corona discharge, the ionizing bar comprising:

means for receiving the non-ionized gas stream and for directing the clean ionized gas stream toward the charge neutralization target;

means for exhausting the contaminant gas stream from the ionizing bar and away from the charge neutralization target; and plural shell assemblies, each assembly comprising:

a shell having an orifice in gas communication with the means for receiving such that a portion of the non-ionized gas stream may enter the shell;

means for producing ions and contaminant byproducts in response to application of the ionizing electrical potential such that at least a substantial portion of the produced ions migrate into the non-ionized gas stream to thereby form the clean ionized gas stream that is drawn toward the charge neutralization target by the non-ionizing electrical field, wherein the means for producing comprises at least one ionizing electrode having a tip that produces a plasma region, comprising ions and contaminant byproducts, in response to application of the ionizing electrical potential, the ionizing electrode being disposed within the shell such that the tip is recessed from the shell orifice by a distance that is substantially equal to the size of the plasma region; and means for presenting a gas pressure within the shell and in the vicinity of the orifice that is lower than the pressure of the non-ionized gas stream outside the shell and in the vicinity of the orifice, the means for presenting being in gas communication with the means for exhausting and the shell whereby a portion of the non-ionized gas stream flows into the shell and sweeps at least a substantial portion of the contaminant byproducts into the contaminant gas stream exhausted by the means for exhausting, wherein the means for presenting comprises a conductive hollow socket within which the ionizing electrode is seated such that the ionizing electrical potential may be applied to the electrode through the means for presenting.

12. The ionizing bar of claim 11 wherein the ionizing electrical potential is a radio-frequency electrical potential that periodically exceed both the positive and negative corona threshold of the ionizing electrode whereby the plasma region is substantially electrically balanced and the byproducts are substantially neutralized.

13. The ionizing bar of claim 11 wherein at least a substantial portion of the byproducts are gases evacuated through the means for presenting and selected from the group consisting of ozone and nitrogen oxides.

14. The ionizing bar of claim 11 wherein the ionizing electrical potential is a radio-frequency electrical potential that periodically exceed both the positive and negative corona threshold of the means for producing whereby the means for producing produces both positive and negative ions.

15. The ionizing bar of claim 11 wherein the means for producing comprises a tapered emitter pin with a sharp point that produces a plasma region during corona discharge of ions, the point facing the shell orifice and being recessed from the shell orifice by a distance that is substantially equal to the size of the plasma region;

the shell orifice is generally circular and has a diameter; and the ratio of the shell orifice diameter and the recess distance is between about 0.5 and about 2.0.

16. The ionizing bar of claim 11 wherein the means for producing is made of a material selected from the group consisting of metallic conductors, non-metallic conductors, semiconductors, single-crystal silicon and polysilicon; and the means for presenting is connected to a source of low pressure and provides gas flow in the shell in the range of about 0.1-20 liters/min. to thereby evacuate at least a substantial portion of the byproducts.

17. The ionizing bar of claim 11 wherein the non-ionized gas is an electropositive gas;

the ionizing potential is a radio-frequency ionizing electrical potential; and the means for producing produces a plasma region comprising electrons, positive and negative ions and byproducts.

18. The ionizing bar of claim 11 further comprising at least one non-ionizing electrode for superimposing, into the plasma region, a non-ionizing electric field that induces at least a substantial portion of the ions to migrate through the shell orifice and into the non-ionized gas stream that is directed toward the charge neutralization target.

19. An ionizing bar that directs a clean ionized gas stream toward an attractive non-ionizing electric field of a charge neutralization target, the ionizing bar receiving a non-ionized gas stream, exhausting a contaminant gas stream away from the charge neutralization target, and receiving an ionizing electrical potential sufficient to induce corona discharge at least one electrode, the ionizing bar comprising:

at least one gas channel that receives the non-ionized gas stream and that directs the clean ionized gas stream toward the charge neutralization target;

at least one evacuation-channel that exhausts the contaminant gas stream from the ionizing bar and away from the charge neutralization target; and at least one shell assembly, each shell assembly comprising:

a shell having an orifice in gas communication with the gas channel such that a portion of the non-ionized gas stream enters the shell;

at least one ionizing electrode that produces a plasma region, comprising charge carriers and contaminant byproducts, in response to application of the ionizing electrical potential, the ionizing electrode being disposed within the shell such that the plasma region is recessed from the shell orifice whereby at least a substantial portion of the produced charge carriers migrate into the non-ionized gas stream to thereby form the clean ionized gas stream that is drawn toward the charge neutralization target by the non-ionizing electric field; and at least one evacuation port, in gas communication with the evacuation-channel and the shell, that presents a gas pressure within the shell and in the vicinity of the shell-orifice that is lower than the pressure of the non-ionized gas stream outside the shell and in the vicinity of the shell-orifice, whereby a portion of the non-ionized gas stream flows into the shell and sweeps at least a substantial portion of the contaminant byproducts into the contaminant gas stream exhausted by the evacuation-channel.

20. The ionizing bar of claim 19 wherein there are plural shell assemblies;

each shell assembly has one ionizing electrode with a tapered pin having a sharp point facing the shell orifice; and each shell assembly has an evacuation port comprising a conductive hollow socket within which the tapered pin is seated such that the ionizing electrical potential may be applied to the pin through the evacuation port.

21. The ionizing bar of claim 19 wherein there is one shell assembly having an ionizing electrode comprising a substantially linear corona wire that produces a generally cylindrical plasma region, comprising charge carriers and contaminant byproducts, when presented with an ionizing electrical potential;

the shell orifice is a slot that is elongated in a direction that is at least generally parallel to the corona wire.

22. The ionizing bar of claim 19 wherein there is one shell assembly having an ionizing electrode comprising a substantially linear corona saw-blade that produces a generally planar plasma region, comprising charge carriers and contaminant byproducts, when presented with an ionizing electrical potential;

the shell orifice is a slot that is elongated in a direction that is at least generally parallel to the corona saw-blade.

23. The ionizing bar of claim 19 further comprising at least one non-ionizing electrode for superimposing, into the plasma region, a non-ionizing electric field that induces at least a substantial portion of the ions to migrate through the shell orifice and into the non-ionized gas stream that is directed toward the charge neutralization target.

24. An ionizing bar that directs a clean ionized gas stream toward an attractive non-ionizing electric field of a charge neutralization target, the ionizing bar receiving a non-ionized gas stream, exhausting a contaminant gas stream away from the charge neutralization target, receiving a positive ionizing electrical potential sufficient to induce corona discharge at a positive ionizing electrode, and receiving a negative ionizing electrical potential sufficient to induce corona discharge at a negative ionizing electrode, the ionizing bar comprising:

at least one gas channel that receives the non-ionized gas stream and that directs the clean ionized gas stream toward the charge neutralization target;

at least one evacuation-channel that exhausts the contaminant gas stream from the ionizing bar and away from the charge neutralization target;

at least one positive shell assembly comprising:

a positive shell having an orifice in gas communication with the gas channel such that a portion of the non-ionized gas stream enters the positive shell;

at least one positive ionizing electrode having a tip that produces a plasma region, comprising ions and contaminant byproducts, in response to application of the positive ionizing electrical potential, the positive electrode being disposed within the positive shell such that the tip is recessed from the shell orifice by a distance that is substantially equal to the size of the plasma region whereby at least a substantial portion of the produced ions migrate into the non-ionized gas stream to thereby form the clean ionized gas stream that is drawn toward the charge neutralization target by the non-ionizing electric field; and at least one evacuation port, in gas communication with the evacuation-channel and the shell, that presents a gas pressure within the positive shell and in the vicinity of the orifice that is lower than the pressure of the non-ionized gas stream outside the positive shell and in the vicinity of the orifice, whereby a portion of the non-ionized gas stream flows into the positive shell and sweeps at least a substantial portion of the contaminant byproducts into the contaminant gas stream exhausted by the evacuation-channel; and at least one negative shell assembly comprising:

a negative shell having an orifice in gas communication with the gas channel such that a portion of the non-ionized gas stream enters the negative shell;

at least one negative ionizing electrode having a tip that produces a plasma region, comprising ions and contaminant byproducts, in response to application of the negative ionizing electrical potential, the negative electrode being disposed within the negative shell such that the tip is recessed from the shell orifice by a distance that is substantially equal to the size of the plasma region whereby at least a substantial portion of the produced ions migrate into the non-ionized gas stream to thereby form the clean ionized gas stream that is drawn toward the charge neutralization target by the non-ionizing electric field; and at least one evacuation port, in gas communication with the evacuation-channel and the shell, that presents a gas pressure within the negative shell and in the vicinity of the orifice that is lower than the pressure of the non-ionized gas stream outside the negative shell and in the vicinity of the orifice, whereby a portion of the non-ionized gas stream flows into the negative shell and sweeps at least a substantial portion of the contaminant byproducts into the contaminant gas stream exhausted by the evacuation-channel.

25. The ionizing bar of claim 24 further comprising plural pairs of positive and negative shell assemblies wherein the positive and negative shell assemblies are arranged such that every other shell assembly is a negative shell assembly and such that all of the shell orifices at least generally face the charge neutralization target.

26. The ionizing bar of claim 25 wherein the gas channel further comprises plural nozzles, disposed between adjacent ones of the shell assemblies, through which non-ionized gas may be directed toward the charge neutralization target to thereby urge the clean ionized gas stream toward the charge neutralization target.

27. The ionizing bar of claim 25 further comprising a positive conductive bus electrically coupled to the plural positive ionizing electrodes for receiving the positive ionizing electrical potential and for providing the positive ionizing electrical potential to the plural positive ionizing electrodes; and a negative conductive bus electrically coupled to the plural negative ionizing electrodes for receiving the negative ionizing electrical potential and for providing the negative ionizing electrical potential to the plural negative ionizing electrodes.

28. The ionizing bar of claim 27 wherein the evacuation-channel further comprises an electrically insulating surface; and at least one of the positive and negative busses are disposed on the electrically insulating surface of the evacuation-channel.

29. The ionizing bar of claim 24 wherein the ionizing bar further comprises a positive conductive bus that receives the positive ionizing electrical potential;

the positive ionizing electrode comprises a tapered pin and the tip comprises a sharp point at a free end of the tapered pin; and the evacuation port comprises a conductive hollow socket within which the tapered pin is seated and which is electrically coupled with the positive conductive bus such that the positive ionizing electrical potential may be applied to the tapered pin through the evacuation port and the positive bus.

30. The ionizing bar of claim 24 wherein at least a substantial portion of the byproducts are gases evacuated through the evacuation port and selected from the group consisting of ozone and nitrogen oxides.

31. The ionizing bar of claim 24 wherein the negative ionizing electrode comprises a tapered pin and the tip comprises a sharp point at a free end of the tapered pin;

the negative shell orifice is generally circular and has a diameter; and the ratio of the negative shell orifice diameter and the recess distance is between about 0.5 and about 2.0.

32. The ionizing bar of claim 24 wherein the negative ionizing electrode is made of a material selected from the group consisting of metallic conductors, non-metallic conductors, semiconductors, single-crystal silicon and polysilicon; and the negative evacuation port is connected to a source of low pressure and provides gas flow in the negative shell in the range of about 1-20 liters per minute to thereby evacuate at least a substantial portion of the byproducts.

33. The ionizing bar of claim 24 wherein the positive and negative shell assemblies are positioned along the ionizing bar such that:

the ionizing electrical potential applied to the positive ionizing electrode imposes a non-ionizing electric field to the plasma region of the negative shell assembly sufficient to induce at least a substantial portion of the negative ions to migrate into the non-ionized gas stream; and the ionizing electrical potential applied to the negative ionizing electrode imposes a non-ionizing electric field to the plasma region of the positive shell assembly sufficient to induce at least a substantial portion of the positive ions to migrate into the non-ionized gas stream.

34. The ionizing bar of claim 24 further comprising at least one non-ionizing electrode for superimposing, into the plasma region, a non-ionizing electric field that induces at least a substantial portion of the ions to migrate through the shell orifice and into the non-ionized gas stream that is directed toward the charge neutralization target.

* * * * *